US005183161A

United States Patent [19]

Mueller

[11] Patent Number: 5,183,161

[45] Date of Patent: Feb. 2, 1993

[54] PROCESS AND APPARATUS FOR SEPARATING GRAIN MIXTURE

[75] Inventor: Roman Mueller, Niederuzwil, Switzerland

[73] Assignee: Buehler AG, Uzwil, Switzerland

[21] Appl. No.: 794,299

[22] Filed: Nov. 14, 1991

Related U.S. Application Data

[63] Continuation of Ser. No. 391,554, filed as PCT/EP88/01078, Jul. 21, 1989, published as WO 89/04721, Jun. 1, 1989, abandoned.

[30] Foreign Application Priority Data

Nov. 27, 1987 [CH] Switzerland ..... 04626/87
Mar. 24, 1988 [CH] Switzerland ..... 01110/88

[51] Int. Cl.[5] ..... B03B 4/00

[52] U.S. Cl. ..... 209/467; 209/486; 209/498; 209/502

[58] Field of Search ..... 209/467, 469, 466, 468, 209/502, 486, 497, 498

[56] References Cited

U.S. PATENT DOCUMENTS

| | | | |
|---|---|---|---|
| 824,623 | 6/1906 | Campbell | 209/468 |
| 1,701,624 | 2/1929 | Lide | 209/467 |
| 1,870,042 | 8/1932 | Dorfan | 209/467 |
| 1,919,303 | 7/1933 | Raw | 209/502 |
| 1,980,490 | 11/1934 | Lide | 209/467 X |
| 3,406,824 | 10/1968 | Forsberg | 209/467 |
| 3,464,553 | 9/1969 | Hancock | 209/467 |
| 4,466,542 | 8/1984 | Oetiker et al. | 209/467 X |
| 4,652,362 | 3/1987 | Mueller | 209/466 X |

FOREIGN PATENT DOCUMENTS

| | | | |
|---|---|---|---|
| 711465 | 9/1931 | France | 209/466 |

*Primary Examiner*—Donald T. Hajec
*Attorney, Agent, or Firm*—McAulay Fisher Nissen Goldberg & Kiel

[57] ABSTRACT

Process and apparatus for separating grain mixture, e.g. for separating heavy inclusions, such as stones (28), from grain product, in which the product is guided via an inclined oscillating layering table surface, through which air flows, so as to be substantially layered and the layering air is guided as recycle air, wherein the recycle air used for the layering of the product is guided through separate guides for the inlet and outlet air, and the guides are oscillated jointly with the layering table surface.

8 Claims, 10 Drawing Sheets

PROCESS AND APPARATUS FOR SEPARATING GRAIN MIXTURE

No. 391,554, filed as PCT/EP88/01078, Jul. 21, 1989, published as WO 89/04721, Jun. 1, 1989, now abandoned.

BACKGROUND OF THE INVENTION

The invention is directed to a process for separating grain mixture, e.g. for separating heavy inclusions such as stones from grain product, in which the product is guided so as to be substantially layered via an inclined oscillating layering table surface through which air flows, and the layering air is guided as recycle air.

A grain separating device is known from GB-PS 1 536 905 which works in recycle-air operation and consists substantially of an oscillating table surface and a stationary box which completely encloses the table surface. The stationary box comprises a ventilator in its lower area by means of which the air is blown through the table surface from the bottom toward the top. The air flowing up from the table surface is guided back into the input of the ventilator laterally between the oscillating table surface and the walls of the stationary box. The air is guided in circular movement. This is designated as recycle-air operation. This has the great advantage that costly aspiration systems comprising corresponding filtering devices for the layering air can be dispensed with. But the fact is that these recycle-air systems have so far been successful only in very limited scope.

It has been determined in general that the devices working with recycle-air operation are either complicated with respect to construction or do not enable a satisfactory separating quality, e.g. a sufficiently high separating efficiency for the separation of stones. The reason for this consists in part in that compromises with respect to the guidance of product, particularly guiding the product in and out, and with respect to the guidance of the air must be made for recycle-air operation. In order for the oscillating table to oscillate freely, it is necessary either to provide sufficient play between the oscillating parts and stationary parts or to arrange flexible rubber bands around the entire table surface, which has a negative influence on the oscillating behavior of the table. False air normally interferes with the formation of a favorable product layering and accordingly with the successful separation of the different product components. The real problem remaining unsolved was that of the collection of dust, dirt and husk or hull parts inside the stationary box. The type of apparatus in question is predominantly that used for the separation of foreign impurities from grains and other seed materials, wherein e.g. 1–2% foreign impurities is very common. With throughput capacities of e.g. 5–20 tons per hour, there are large quantities even for the small amount of unwanted impurities. Therefore, recycle-air systems make greater demands on the plant operator because of higher expenditures for cleaning; otherwise, they are problematic with respect to hygiene. Therefore, out of the theoretical advantages there remain only great practical disadvantages. In the known recycle-air devices, dust-containing air often escaped into the environment, since the pressure conditions were not sufficiently under control.

BRIEF SUMMARY OF THE INVENTION

The object of the invention is to provide a new separating process working in recycle-air operation which permits a high throughput with the greatest possible reduction of the disadvantages of the known solutions.

The invention is solved in a process according to the generic type in that the recycle air used for the layering of the product is guided through separate guides for the inlet air and outlet air, wherein the guides are oscillated jointly with the layering table surface.

In addition, in order to meet the indicated object, the invention has the advantage of a high separating quality, a simple construction and clean operation.

The formation of an oscillating unit from layering table and air guides has the very special advantage that virtually every point of attachment for the depositing of dust, etc. is effectively prevented with a "little more" oscillating mass. Not only is the effect by which the air carries away the dust active; by means of the oscillation of all wall parts coming into contact with dust, these wall parts are constantly shaken clean.

The arrangement of the product feed in the area of the table end which is situated higher and the arrangement of the air suction approximately in the center area above the layering table and, in addition, the arrangement of the air return around the lower area of the layering table has proven to be a particularly surprising advantage for the oscillating unit. Each of the functions can be optimized in a way which was previously possible without recycle air only in the best individual machines. The oscillating product feed or product supply which widens from the top to the bottom and is formed in a cascading manner ensures a full spreading out and loosening of the product from the start while simultaneously functioning as air lock. The arrangement of the product feed cascade in the area of the table end which is situated higher ensures flow conditions which are free of obstacles and can accordingly be kept under control in a favorable manner, not only through but also above the entire layering table area. The air return in the form of a recycle-air feed duct, which is guided around the lower table end and opens out below the latter across a wide surface area, is likewise directed to ensuring optimal flow conditions. But, in addition, it is particularly important that the recycle air be guided smoothly and so as to be substantially free of eddying from and to the layering operation. Depending on need, the recycle air can be cleaned in devices which are arranged so as to be stationary. Since the corresponding air remains in circulation permanently, a mechanical cleaning without filtering is sufficient. However, it is also possible to guide only a small portion of the recycle air into a dust filter. This has the additional advantage that the entire system remains under vacuum pressure externally.

The invention is directed further to an apparatus for separating grain mixtures, particularly for separating heavy inclusions, such as stones, from grain product, comprising an inclined layering table through which air flows, which layering table is oscillated and comprises air guides for a recycle-air operation of the apparatus; the invention is characterized in that the layering table and the guides for the air suction and the air return form an oscillating box.

It was really a surprise for participating experts that all disadvantages named in the beginning are eliminated with the new separating device which works in recycle-air operation.

The problem of the collection of dust on the apparatus is effectively eliminated in that not only the parts necessary for the functioning of the separating work, but also the inlet air and outlet air ducts for the air are oscillated. The fine dust simply passes through the apparatus. An easily controllable oscillating box can be formed in which each function is spatially allocated in a clear manner. The product feed is preferably arranged on the side of the end of the layering table which is situated higher. Removals can be effected at this side for servicing on the layering table. The air return is preferably arranged at the other, lower end. This air return can be constructed as a flat duct or channel so that air flowing out of it enters into the lower table surface so as to be free of eddying. The air suction is arranged in the central upper area of the box. The connection of the oscillating parts with the stationary parts with respect to product and flow can be effected by means of round material sleeves or rubber sleeves, as is effected in practice in a great many oscillating machines without difficulty.

A particularly advantageous design idea consists in that one or two table surfaces can be arranged in the same oscillating box, wherein the lower table takes over a portion of the product of the upper table and the product transfer can preferably be effected at the table end which is situated higher.

But the upper table surface can also comprise—even additionally in some circumstances—a trough-shaped recess (stone or product sump) in its area which is situated lower, which recess comprises fall-through openings in the trough base for separating the product flow into a heavy fraction and a light fraction. In this case, the product transfer from the upper table to the lower table takes place via a chute which is arranged in the opposite direction of the main flow direction of the upper table and opens out on the lower table.

A high efficiency of grain separation, particularly also de-stoning, can be achieved with the invention. Moreover, in an advantageous manner, little air is needed and the process and the apparatus are simple and, in particular, have low sensitivity to fluctuations in throughput and do not collect dust inside.

Some embodiment examples of the invention are explained in further detail in the following.

DETAILED DESCRIPTION

Figure 1:
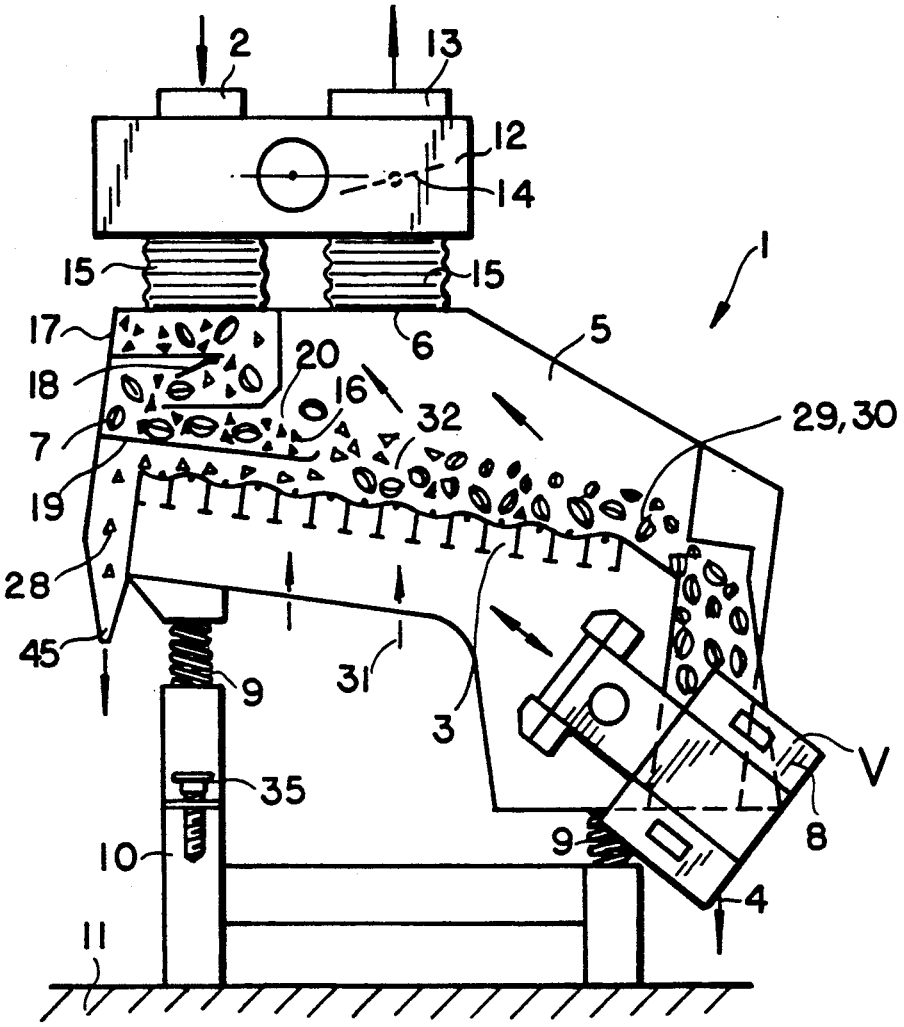
FIG. 1 shows the simplest form of a small table separator for stones.
Figure 2:
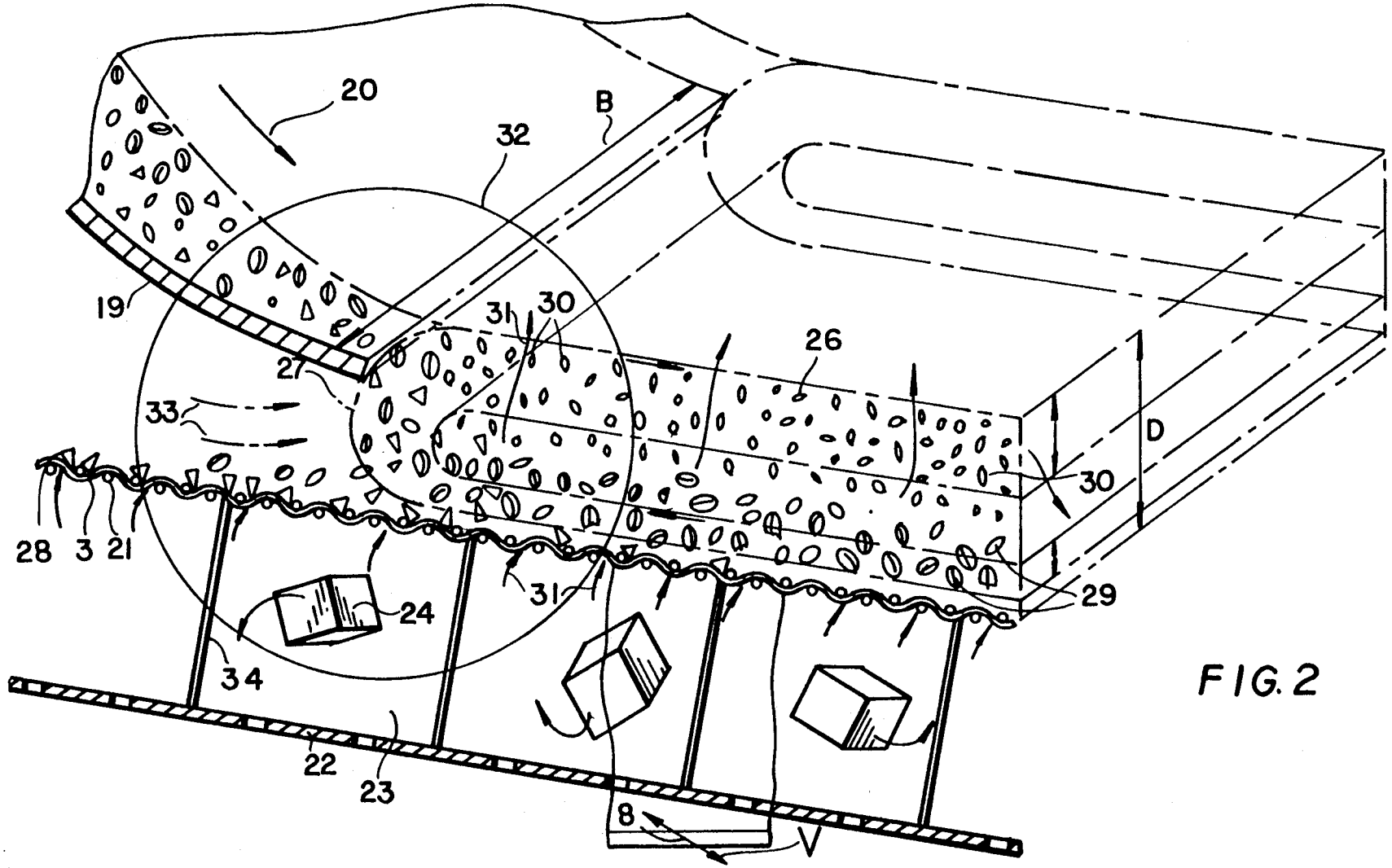
FIG. 2 shows the product feed on the layering table.

FIGS. 1 and 2 are referred to in the following. FIG. 1 shows a basic type for a new de-stoner 1, wherein the fresh grain material is guided to a layering table 3 through an inlet 2 and is guided away from the layering table 3 via an outlet 4 as cleaned grain product. A closed hood 5 which comprises a suction opening 6 is arranged over the layering table 3. Together with the layering table 3, the hood 5 forms an oscillating device 7 which can be oscillated by means of an oscillator 8 with an oscillating component in the direction of the upper end of the layering table 3. The upper end of the layering table 3 is constructed by means of a guide sheet 19 as final separating zone. The entire oscillating unit 7 is supported via spring elements 9 on a frame 10 which is secured so as to be upright on a floor 11. A non-oscillating head part 12, in which the inlet 2 and an air suction line 13 are arranged, is likewise securely connected with the frame 10. In addition, an air quantity adjusting flap 14 for adjusting the air which is aspirated through the entire de-stoner 1 is arranged in the air suction line 13. The connection of the oscillating parts and the oscillating unit 7, respectively, with the head part 12 is effected via flexible sleeves 15 which are arranged downstream of the inlet 2.

As seen in outline, the layering table 3 has a shape which is preferably approximately rectangular. The layering table 3 can be removed for maintenance work at the side of the layering table end which is situated higher. The product transfer point extends along the full width of the table. The width is designated in FIG. 2 by "B:, the layering thickness is designated by "D:. The formation of a product flow 20 across a wide surface area, also called product mist, for the purpose of product feed is effected in two stages. The fresh grain material is guided in a distributor box 17 as part of the oscillating hood 5. The oscillation promotes the uniform, wide distribution of the grain product in the distributor box 17 which, in order to augment this effect, is constructed in a cascading manner so as to widen in a downward direction. A back-up flap 18, which is likewise provided in the distributor box 17, serves the same purpose, so that the grain product is guided, already as a product flow across a wide surface area, directly to the guide sheet 19 extending along the entire table width and then, as uniform, wide product flow 20, to the layering table 3. The spreading of the product flow 20 across a wide surface area is additionally reinforced in that the guide sheet 19 comprises an overflow edge 16 at its free end and is accordingly trough-shaped. For a preliminary separation of heavy material and light material, the trough-shaped guide sheet 19 can also comprise base openings for the passage of the heavy inclusions.

The wide, uniform spreading of the product flow on the layering table 3 is clarified particularly in FIG. 2. The layering is shown in the same Figure in a deliberately overemphasized manner. The layering table 3 comprises a rough mesh grating 21 as product support and is constructed in so-called sandwich construction in a manner known per se, wherein the mesh grating 21 forms the upper side, supported by means of sheet-metal strips 34 which are arranged in the manner of a honeycomb and are held at the bottom by means of a fine perforated sheet 22. Cleaning bodies 24, which keep both the mesh grating 21 and the perforated sheet 22 clean, are arranged in the individual fields 23 between the sheet-metal strips 34. It is also important in this respect that the perforated sheet 22 have an air resistance which is much greater than the air resistance of the mesh grating 21, e.g. in the order of magnitude of 1:10. By means of this step, the air distribution can be kept approximately constant on the entire surface of the layering table 3 regardless of the layering thickness on the mesh grating 21.

The product layering itself substantially consists of three different layers, wherein a lower heavy layer 25 containing the heavy inclusions is conveyed up the table by means of the mechanical impelling oscillating movement. A light layer 26, from which the heavy inclusions have been separated, is not only kept in the loose state but is also suspended at a distance above the mesh grating 21 by means of the directed air flow. Since the layering table 3 is slightly inclined and the upper light layer 26 does not receive any direct conveying momentum directed up the table, but is kept in an oscillating state, this light layer floats toward the side of the table which is situated lower. Moreover, the layering table 3 is adjustable with respect to its inclination by means of an adjusting device 35. A third layering 27 consists of the actual heavy inclusions, mostly only individual particles, individual foreign bodies, stones 28, etc. Product, heavy kernels 29 and light parts, e.g. half-kernels, hull parts 30, are shown in the form approximately corresponding to them. The heavy product with the stones 28 sinks immediately to the oscillating table surface 7 and moves up the table by means of the oscillation and the rough table surface constructed as mesh grating 21.

It is important for the described function that the air flow be correctly guided. A suction-air flow, whose flow direction is indicated by arrows 31, flows through the entire layering table surface uniformly from the bottom to the top. This air flow 31 puts the grain product into a very fluidized state. Since only the heaviest parts, i.e. the stones 28, are separated out on the higher end of the table and are to be conveyed from there into a stone lock 45, a corresponding blow-back flow 33 is formed which prevents light parts or kernels with the heaviest inclusions from being conveyed upward along with them. The blow-back flow is preferably formed under the guide sheet 19. If the guide sheet 19 is securely connected with the hood wall, the air guided into the slot between the guide sheet and layering table can only deflect in direction 33.

Thus, the product, with the exception of the stones 28 located therein, is prevented from wandering further upward prior to the final separating zone by means of the air flow. The stones 28 can continue their movement toward the higher end of the table.

The same blow-back flow 33 causes a flow front or flow direction reversal 32 which clearly occurs in practice. At the point of the flow direction reversal 32, the grain product 29, from which the stones 28 have been separated, is lifted from the table surface by means of the strong air flow 31, 33 and now flows freely down the table together with all light product with the upper lifted light layer 26. The lightest fraction is immediately discharged in the outlet 4; a medium grain fraction, particularly borderline kernels, can possibly repeat a circular migrating movement up and down the table several times.

In FIGS. 1 and 2, the product flow 20 is fed directly into the zone of the flow direction reversal 32. The flow direction reversal 32 is produced from the three forces consisting of the mechanical conveying action up the table, the floating of the upper layer 26 down the table, and the blow-back flow 33.

Figure 3:
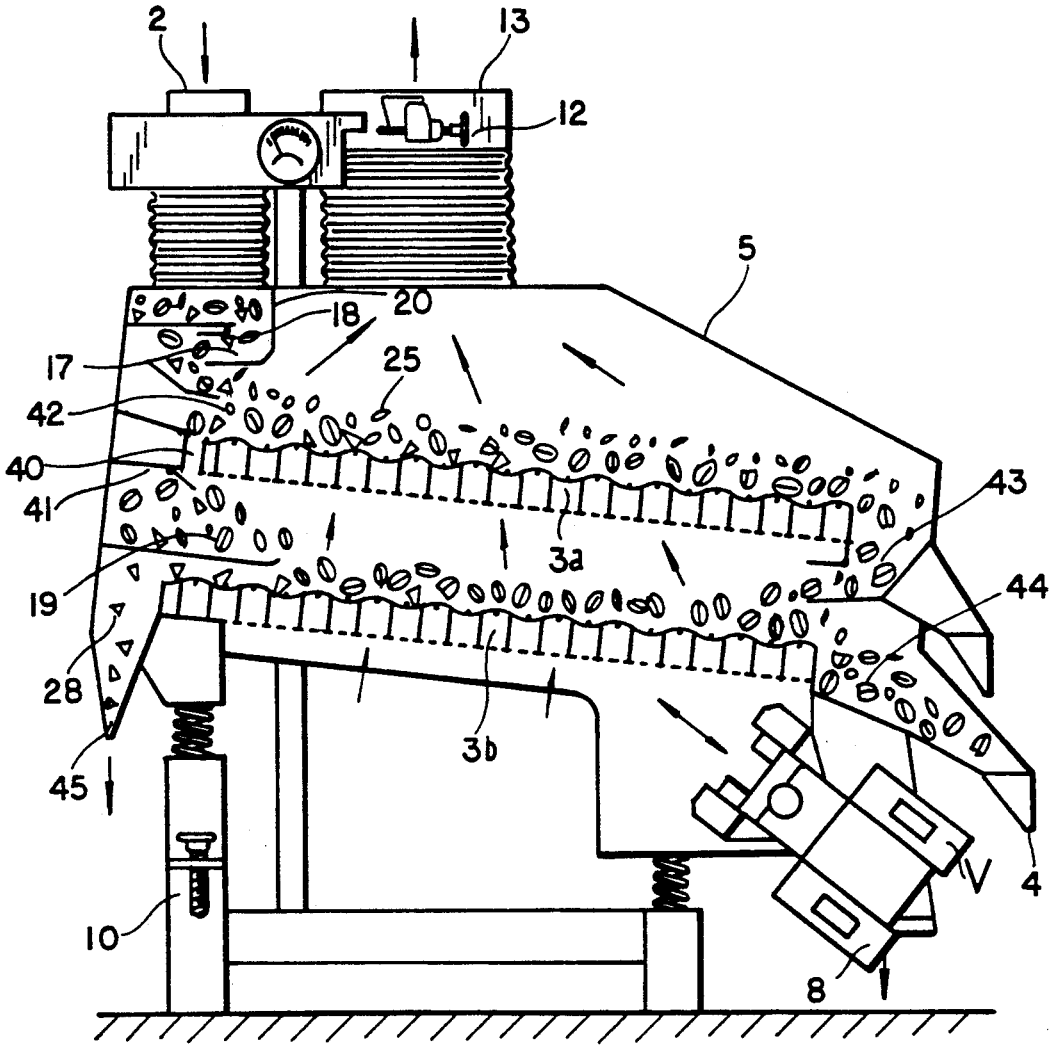
FIG. 3 shows the same solution arrangement as FIG. 1, but with two table surfaces, particularly for a large product throughout.

The main difference between FIG. 3 and FIG. 1 in terms of construction consists in that two layering tables, an upper layering table **3*a* and a lower layering table 35, are used in FIG. 3. The two layering tables 3*a* and 3*b* have basically the same construction, e.g. as in FIG. 2. The blow-back flow 33 is absent, in principle, in the upper layering table 3*a*, so that not only the heaviest inclusions, but the entire heavy layer 25 is moved down the table and can fall onto the guide sheet 19 through an outlet duct 40 via a deflecting plate 41. After the guide sheet 19, the manner of operation of the layering table 3*b* is identical to that of the layering table 3 of FIGS. 1 and 2**, respectively.

In order to prevent the newly fed product flow 20 from the distributor box 17 from being directly mixed with the heavy layer 25, a guide plate 42 is arranged between the distributor box 17 and the layering table **3*a*** at the uppermost point.

The product flow flowing down is released directly into an outlet duct 44 of the lower layering table **3*b* via a product lock 43. The two product flows of the two layering tables 3*a* and 3*b* from which the heaviest inclusions have been separated are then guided together again in outlet 4. All of the heaviest inclusions, such as stones 28, etc., are first separated off from the upper layering table 3*a* together with the heavy layer 25. The actual separating and separate disposal of the stones 28 first takes place on the lower layering table 3*b* via the stone lock 45. The de-stoning takes place in this instance in two separate stages with respect to time and space. That is, first a concentrate formation of all heavy material, e.g. 30% to 60% of the entire product throughput, is effected on the upper layering table 3*a***, and the stones and other heaviest inclusions are separated out and guided away separately first from the reduced product throughput.

Figure 4:
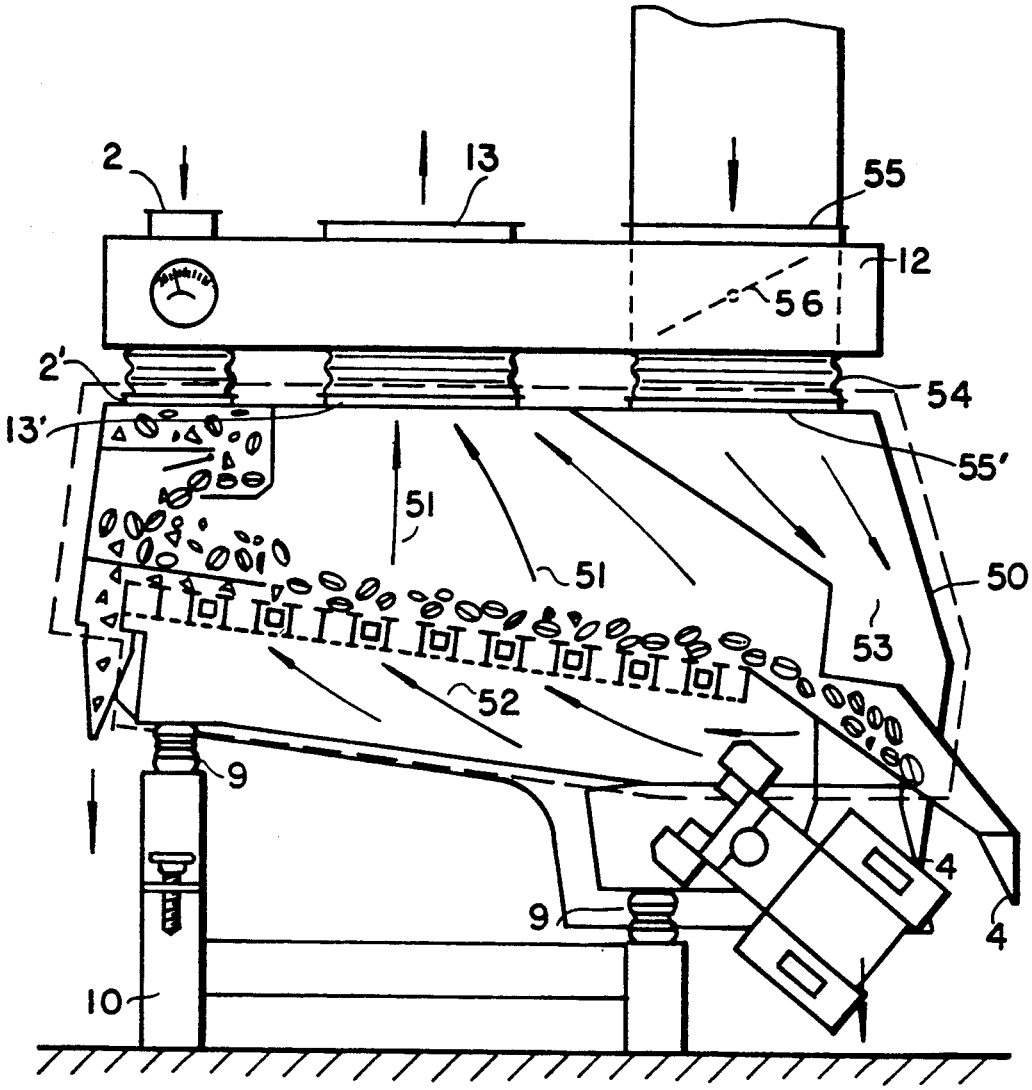
FIG. 4 shows a solution according to FIG. 1, but with a recycle-air duct.
Figure 5:
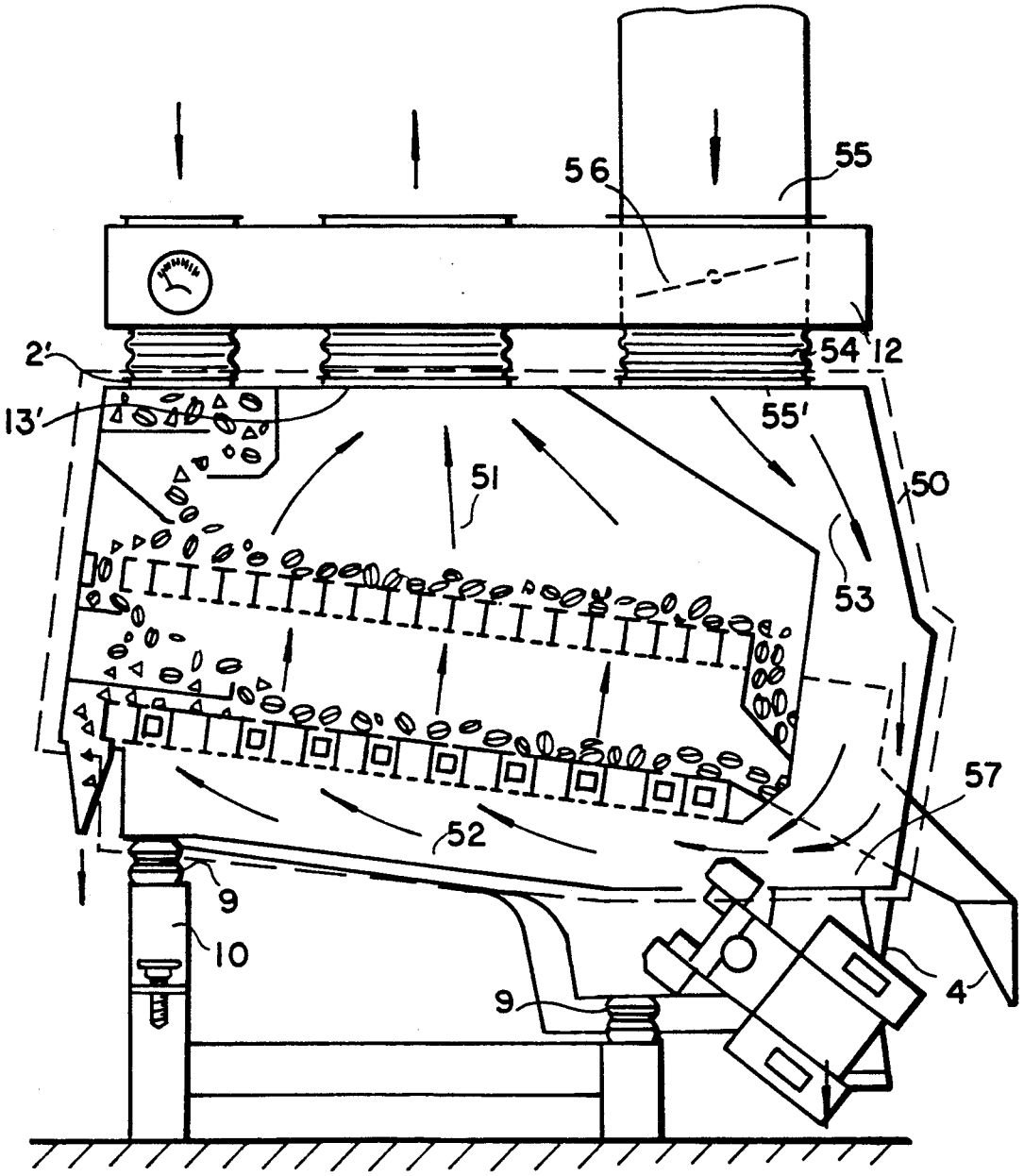
FIG. 5 shows a solution according to FIG. 3, but with a recycle-air duct.

With respect to the product guidance, FIG. 4 is identical to FIG. 1, and FIG. 5 corresponds to FIG. 3. The solution idea of FIG. 4 and FIG. 5, however, additionally contains a box 50 which is closed on all sides and is divided into an upper outlet suction space 51 and a lower inlet suction space 52 by means of the layering table or tables, respectively. A recycle-air duct 53, which is connected with an air return line 55 via a flexible tube 54 and an air return connection piece 55', is located laterally at the lower end of the layering table or tables, respectively. An air quantity throttle 56 is arranged in the air return line 55. In FIGS. 4 and 5, the box 50 itself is supported on the stationary frame 10 via spring elements 9. A product inlet connection piece 2' adjoining the product inlet 2 is arranged at the upper side of the box 50 at one end side; an air outlet suction connection piece 13' connected with the air outlet suction line 13 is arranged approximately in the center; and an air return connection piece 55' connected with the air return line 55 is arranged at the opposite end side. The aforementioned connection pieces 2', 13', 55' are connected via flexible sleeves 15, 54 at the non-oscillating head part 12 on the one side and with the box 50 on the other side in order to share in its movement in this way. In the double machine in FIG. 5, two outlets 4 are arranged as tubular product ducts 57 on both sides (vertically relative to the drawing plane), so that the remaining space between the two product ducts 57 remains for the recycle-air duct 53. The box 50 is enclosed by a dashed line in FIGS. 4 and 5 for improved clarity.

Figure 6:
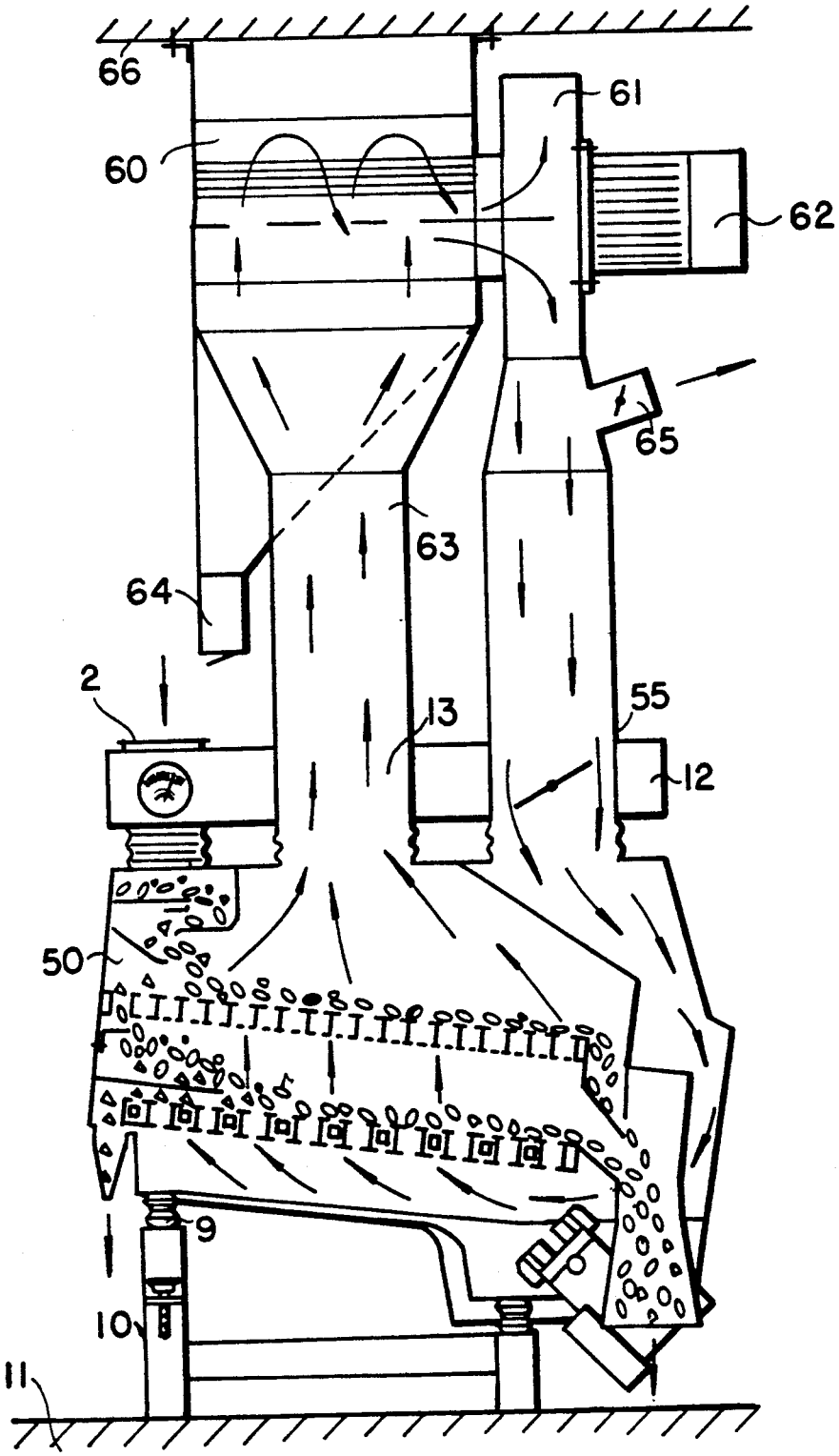
FIG. 6 shows FIG. 5 with recycle-air separator.

By way of addition to FIGS. 4 and 5, a recycle-air separator 60 with suction ventilator 61 and motor drive 62 is shown additionally in FIG. 6. The air outlet suction connection piece 13 leads directly into the recycle-air separator 60, wherein the substantial and bothersome portion of fine hulls and dust is removed from the air flow via a dust removal line 64.

In most cases in which recycle air is used, an air cleaning is advantageous, since a collection of dust can accordingly be effectively prevented in the entire apparatus and the operating reliability and hygiene can be increased. The recycle-air operation has the great advantage that only a minimum quantity of air, e.g. 10% of the circulating air quantity, need be guided via fine dust filters. For this purpose, an aspiration connection 65 is provided. The recycle-air separator 60 can be fastened with the ventilator directly to the ceiling 55.

Figure 7:
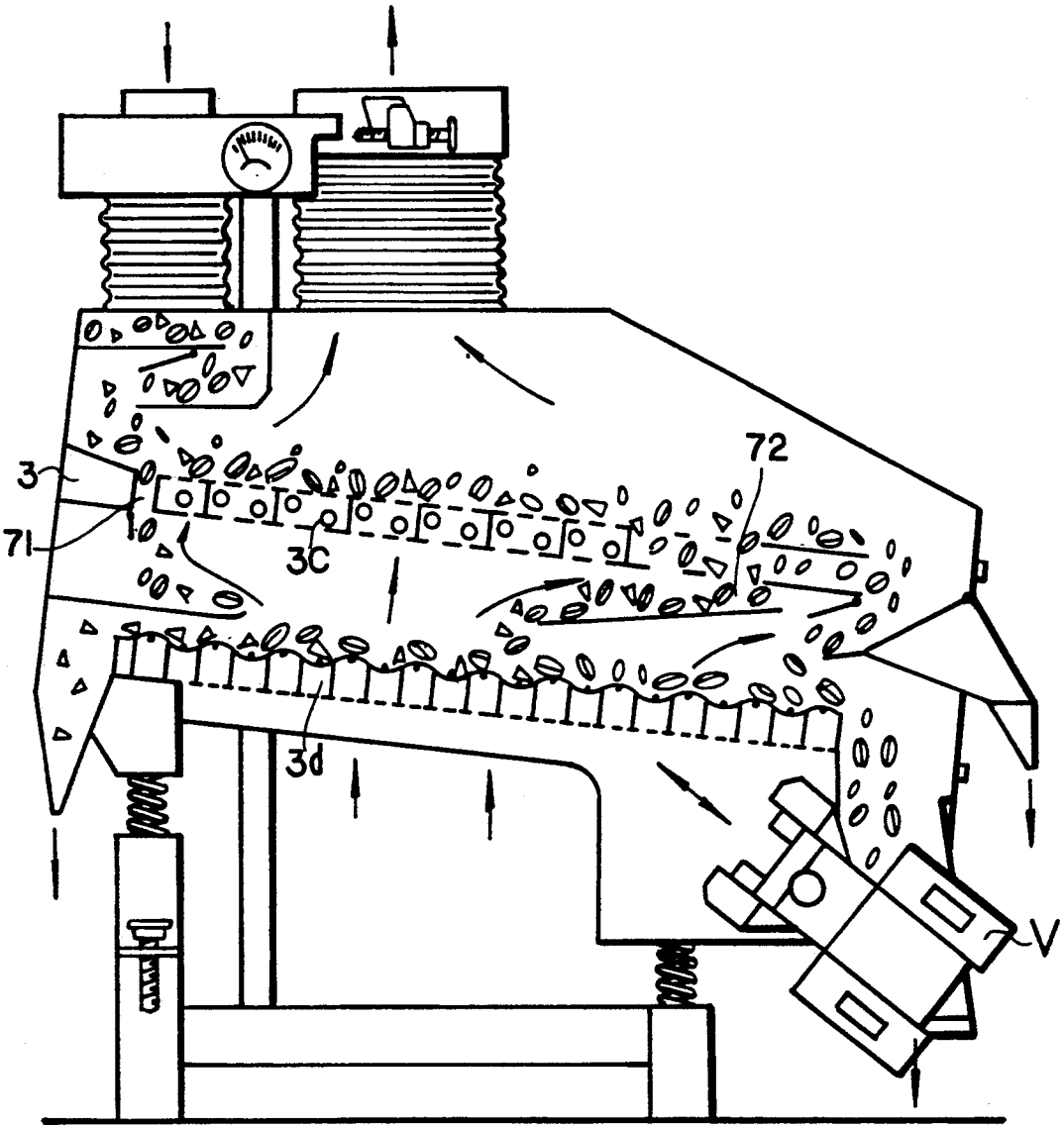
FIG. 7 is a solution similar to FIG. 3 with additional formation of two heavy fractions in addition to de-stoning.

FIG. 7 comprises a basic difference relative to FIG. 3 to the extent that in FIG. 7 only a small part of the product throughput is conveyed from the upper layering table 3*c* at the highest point through a series of larger holes 71 along the entire width of the table down to the upper zone of the flow direction reversal of the lower layering table 3*d*. In the area of the lower table end, the main quantity of heavy material is guided approximately to the center of the lower layering table 3*d* via a chute 72, again along the entire table width. Many series of measurements have shown that in this solution the large portion of stones is nevertheless conveyed directly to the lower layering table 3*d* through the holes 71. In the solutions according to FIGS. 7 and 8, it is important that the upper layering table has a surface which is only less rough than the lower layering table 3*d*, as is shown in FIG. 9, in that the upper layering table 3*c* is formed from a perforated sheet and the lower layering table 3*d* is formed from a mesh grating.

Figure 8:
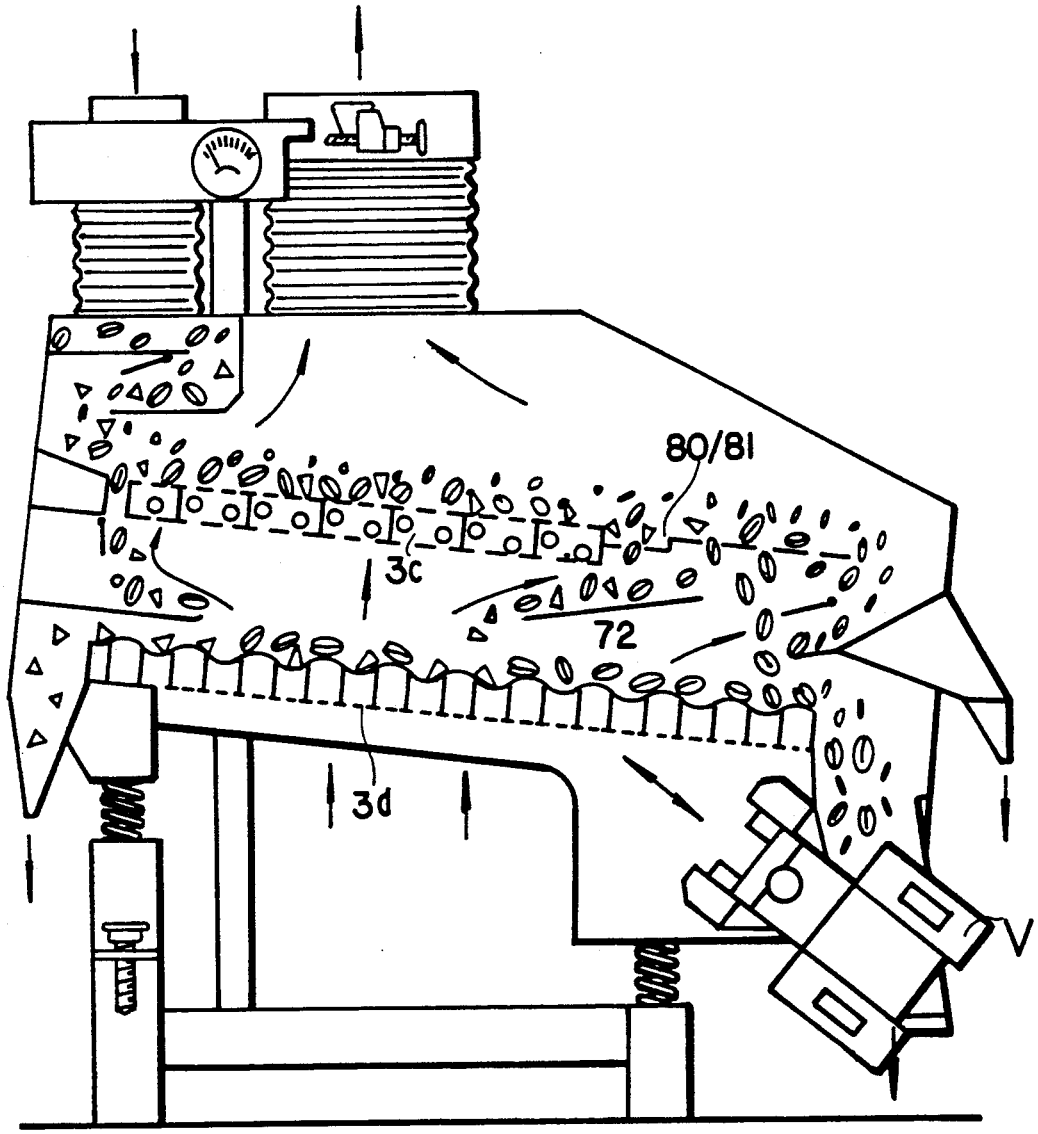
FIG. 8 is a variant of the construction in FIG. 7.
Figure 9:
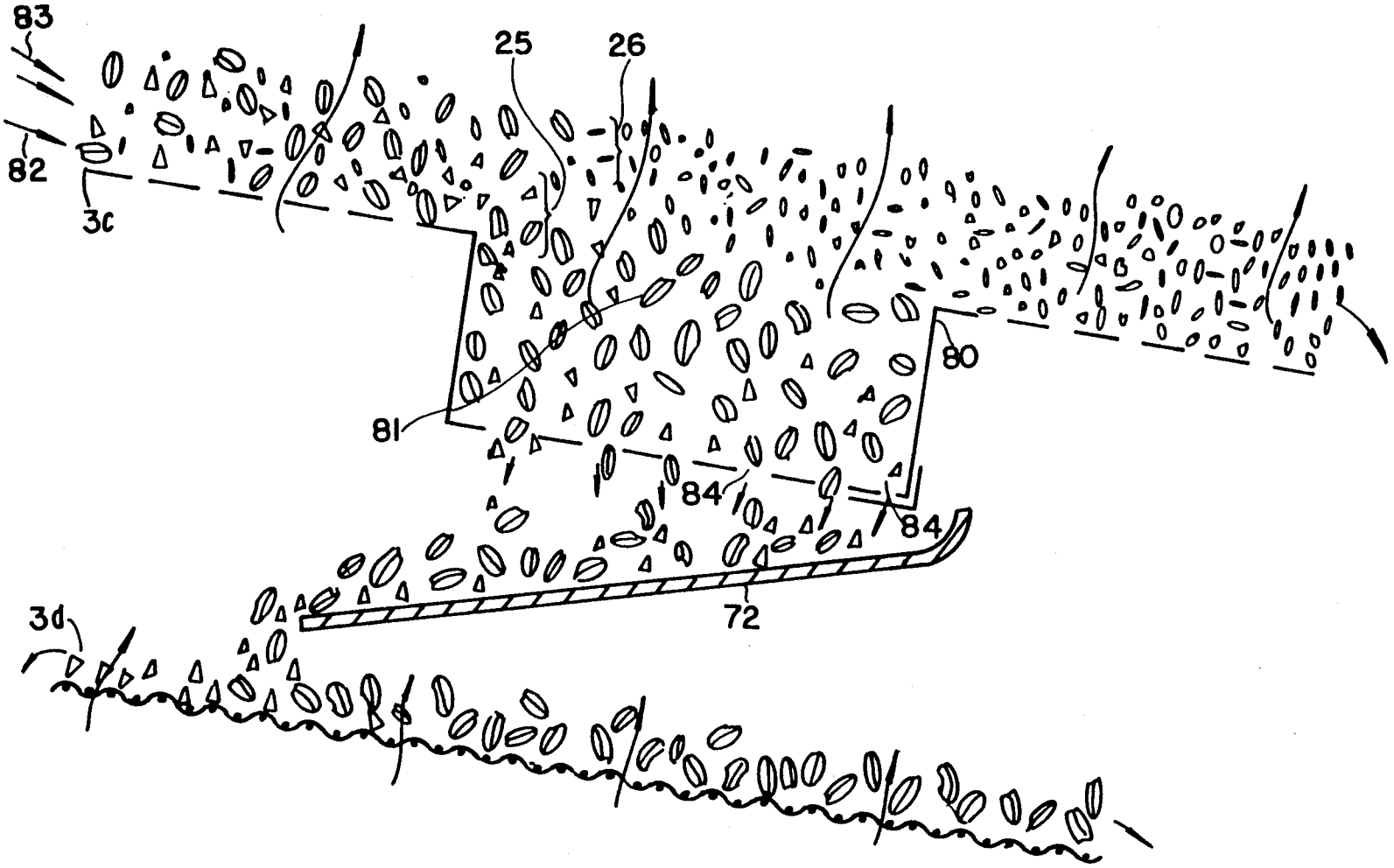
FIG. 9 shows a stone sump on the layering table surface.

A particularly interesting and unique idea is shown in FIGS. 8 and 9; namely, the use of a stone sump 80 in the area of the upper layering table 3*c*. This works as follows: The stone sump 80 consists of a trough-like recess 81 which extends along the entire width of the layering table 3*c*. Similar to FIG. 2, two different layers, namely the heavy layer 25 and the light layer 26, from which heavy inclusions have been separated, are also formed in FIGS. 8 and 9.

Since the surface of the upper layering table 13 has only a slight roughness, no actual upward flow occurs; at least, the entire heavy layer 25 cannot be moved upward. On the contrary, the lower heavy layer 25 flows down the table in a sharply delayed manner as is designated by the single arrow 82. On the other hand, the light layer 26 flows down the table at great speed (double arrow 83). The heavy layer now sinks compulsorily into the stone sump 80 once it has reached the area of the recess 81. At its base, the stone sump 80 comprises a quantity of fall-through openings 84 through which a portion of the product, together with the stones, is discharged on the chute 72 located beneath it and on the lower layering table 3*d*, respectively, in a continuous manner. When the quantity of effective fall-through openings 84 is correctly adapted to the quantity flow of the heavy layer, the light layer and heavy layers can be separated from one another in such a way that the heavy layer 25 sinks completely into the stone sump 80 permanently and is discharged directly downward. Two great advantages result from this:

1. A very high separating efficiency results in this way for the heaviest inclusions (stones, etc.);

2. With only a minimum of extra expenditure, separation into a clean heavy fraction (good kernels) and the rest into a light product fraction (hulls, shriveled and broken kernels) can be effected in addition to the separation of the heaviest inclusions.

Accordingly, it is possible to carry out the separation into the different basic fractions (stones, etc., heavy, light fractions) in a single apparatus and with very high quality.

Figure 10:
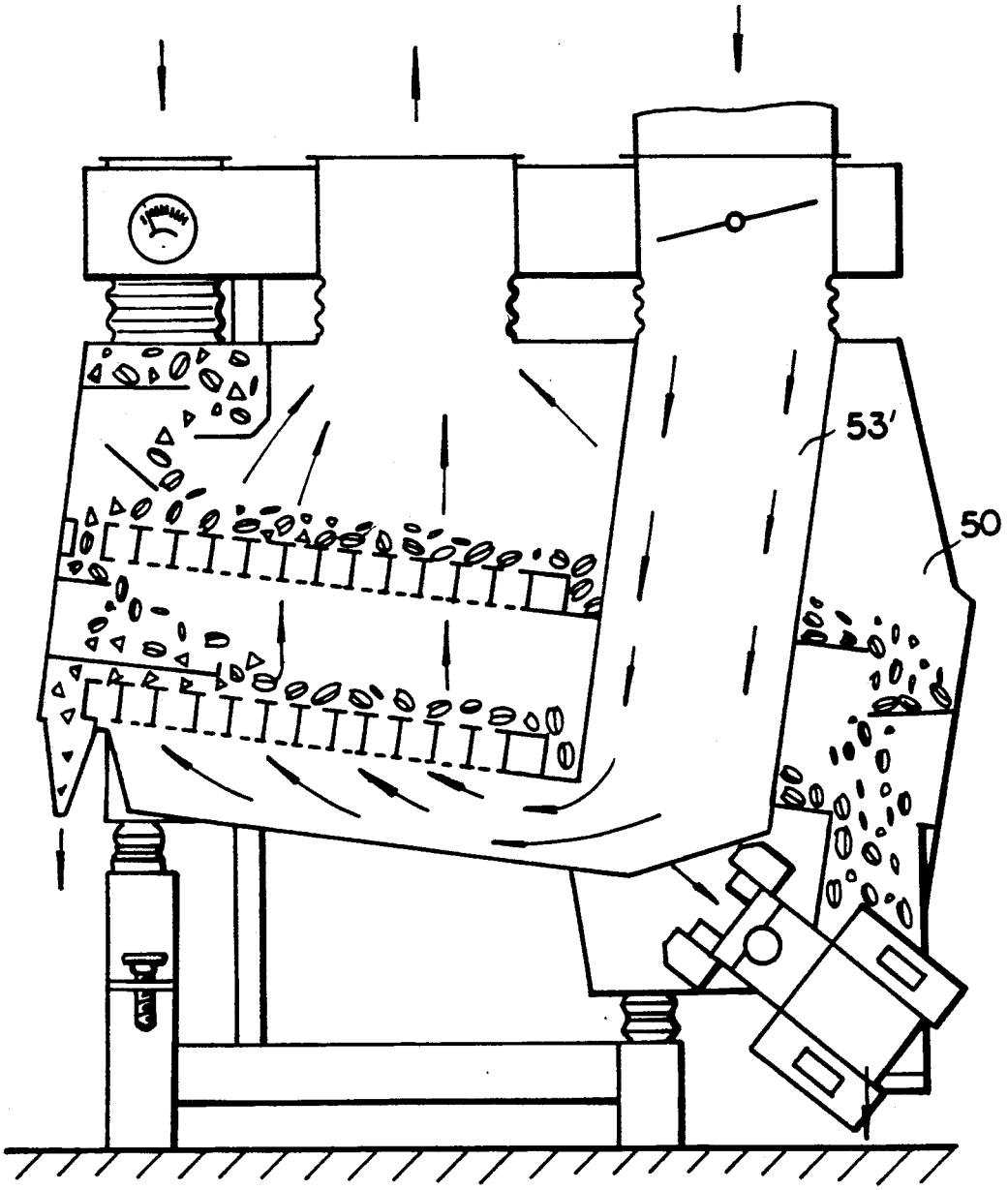
FIG. 10 shows the apparatus as in FIGS. 3, 7 and 8 with recycle-air duct guided through the box.

Finally, FIG. 10 shows an apparatus which functions according to the same principles as the apparatuses according to FIGS. 3, 7 and 8. For this reason, a repetition of the description of the same structural component parts in this place is unnecessary. The apparatus according to FIG. 10 differs from the apparatuses described above only in that a recycle-air duct 53' is arranged separately in the box 50, and its influence on flow characteristics of the air in the box can be prevented.

I claim:

1. Apparatus for separating heavier materials from a product stream of lighter grain materials, the apparatus comprising:

an inclined table permeable to air having a higher and lower end;

oscillating means for oscillating said inclined table so that the heavier material moves in a direction toward the higher end of said table;

distributing means being positioned above the higher end of said table and having a cascade of trays and a guide plate for guiding the product stream to the higher end of said table; and air flow means for supplying air flow through said table in an upward direction to move the lighter material in the direction of the lower end of said table, the higher end of the table defining a separation zone with said distributing means for taking out the heavier materials from the product stream;

said air flow means supplying air flow through the totality of the table in an upward direction to create said separation zone; said guide plate being arranged over the full width of said table and being arranged to oscillate with said cascade of trays and said inclined table;

the upwardly directed air flow being guided between said distributing means and the table, toward the lower end of the table, to create a flow return zone for the lighter material.

2. Apparatus according to claim 1, wherein said distributing means distributes the product stream uniformly over the width of the higher end of said table.

3. Apparatus according to claim 2, wherein said guide plate has an overflow edge at the end of said guide plate which points in the direction of the lower end of said table and said guide plate has openings in the bottom of said plate so that the product stream flows over the overflow edge onto the higher end of said table and the heavier materials are discharged through said openings.

4. Apparatus according to claim 3, further comprising a feed duct for supplying the product stream to said distributing means.

5. Apparatus according to claim 1, further comprising a second inclined table positioned directly below said first mentioned inclined table wherein said second inclined table is positioned in the same flow air stream as said first table.

6. Apparatus according to claim 5, wherein said second table has an upper surface which is rougher than the upper surface of said first mentioned table.

7. Apparatus according to claim 6, wherein the higher end of said first table has at least one discharge chute for distributing the product stream to said second table.

8. Apparatus of claim 7, wherein said first and second tables are positioned so that said discharge chute of said first table feeds the product stream onto the higher end of said second table.

* * * * *